United States Patent [19]

Kim

[11] Patent Number: 4,494,039

[45] Date of Patent: Jan. 15, 1985

[54] GYROTRON TRAVELING-WAVE DEVICE INCLUDING QUARTER WAVELENGTH ANTI-REFLECTIVE DIELECTRIC LAYER TO ENHANCE MICROWAVE ABSORPTION

[75] Inventor: Kyung J. Kim, Burke, Va.

[73] Assignee: The United States of America as represented by the Secretary of the Navy, Washington, D.C.

[21] Appl. No.: 435,155

[22] Filed: Oct. 19, 1982

[51] Int. Cl.[3] ..... H01J 25/00

[52] U.S. Cl. ..... 315/4; 315/3; 315/5; 315/3.5; 333/81 B

[58] Field of Search ..... 315/3, 4, 5, 3.5; 333/81 B

[56] References Cited

U.S. PATENT DOCUMENTS

| | | | |
|---|---|---|---|
| 2,869,023 | 1/1959 | Brewer | 315/3.6 |
| 3,153,767 | 10/1964 | Kyhl | 315/5.42 |
| 3,221,205 | 11/1965 | Sensiper | 315/3.5 |
| 3,789,257 | 1/1974 | Friedman et al. | 315/4 |
| 3,886,398 | 5/1975 | Feinstein | 314/4 |
| 3,886,399 | 5/1975 | Symons | 315/3.5 |
| 3,916,246 | 10/1975 | Preist | 315/3.5 |
| 4,001,630 | 1/1977 | Gross | 315/3.5 |
| 4,038,602 | 7/1977 | Friedman | 315/5 |
| 4,200,820 | 8/1980 | Symons | 315/4 |
| 4,224,576 | 9/1980 | Granatstein et al. | 315/4 |
| 4,298,824 | 11/1981 | Walsh | 315/3 |
| 4,298,824 | 11/1981 | Walsh | 315/4 |
| 4,362,968 | 12/1982 | Chu et al. | 315/4 |
| 4,398,121 | 8/1983 | Chodorow et al. | 315/4 |

FOREIGN PATENT DOCUMENTS

| | | | |
|---|---|---|---|
| 55-113240 | 1/1980 | Japan | 315/4 |

*Primary Examiner*—Saxfield Chatmon

*Attorney, Agent, or Firm*—Robert F. Beers; William T. Ellis; John L. Forrest

[57] ABSTRACT

A gyrotron traveling-wave device including quarter wavelength anti-reflective dielectric layers to enhance microwave absorption. A drift tube made from a hollow waveguide is positioned within the gyrotron to surround an electron beam passing from an electron gun to a cavity. A plurality of parallel highly lossy dielectric suppressor rings are interspaced with a plurality of conductive rings positioned to surround the electron beam and located within the waveguide. An anti-reflective layer is formed on the suppressor rings to enhance the absorption by the rings of radiation due to parasitic oscillations by reducing reflections of incident radiation from the suppressor rings. In an alternate embodiment, one or more suppressor rings including an anti-reflecting layer are located within the cavity.

13 Claims, 4 Drawing Figures

GYROTRON TRAVELING-WAVE DEVICE INCLUDING QUARTER WAVELENGTH ANTI-REFLECTIVE DIELECTRIC LAYER TO ENHANCE MICROWAVE ABSORPTION

BACKGROUND OF THE INVENTION

The present invention relates, in general, to an improved gyrotron traveling-wave device and, more particularly, to a novel method for reducing spurious oscillations thereby improving the efficiency of the device.

The gyrotron is a new type of microwave device employing the electron cyclotron maser mechanism. It ideally consists of an ensemble of monoenergetic electrons following helical trajectories around the lines of an axial magnetic field inside a fast wave structure such as a metallic tube or waveguide. The physical mechanism responsible for the radiation in the gyrotron has its origin in a relativistic effect. Initially, the phases of the electrons in their cyclotron orbits are random, but phase bunching (relativistic azimuthal bunching) can occur because of the dependence of the electron cyclotron frequency on the relativistic electron mass. Those electrons which lose energy to the wave become lighter, rotate faster, and, hence, accumulate phase lead, while those electrons which gain energy from the wave become heavier, rotate slower, and accumulate phase lag. This rotating electron interaction with the wave results in phase bunching such that the electrons radiate coherently and amplify the wave.

In essence, there is an intrinsic preference for relativistic azimuthal phase bunching in the presence of an electromagnetic wave. If the incident wave has a frequency slightly larger than the electron cyclotron frequency or its harmonics, then stimulated emission will occur. Since this bunching mechanism occurs in phase with the electromagnetic wave, the stimulated radiation emission from the bunching is also emitted in phase with the wave, leading to wave amplification.

One of the many problems experienced in gyrotron devices is the presence of undesirable parasitic oscillations. These oscillations alter the quality of the electron beam within the device by causing electron bunching at other than the desired frequency of operation. The parasitic oscillations thus interfere with the operation of the device resulting in a large reduction in the device's efficiency.

The present invention presents a novel solution to the parasitic oscillation problem by providing an improved method for absorbing these oscillations. The entire electron beam energy is then applied to the desired frequency, or mode, of operation with little or no deviation due to unwanted oscillations.

SUMMARY OF THE INVENTION

Accordingly one object of the present invention is to provide a novel means for improving the efficiency of a gyrotron device.

Another object of the present invention is to provide a novel means for suppressing parasitic oscillations in a gyrotron device.

Still another object is to provide an improved drift tube for use in a gyrotron device.

Yet another object is to provide an improved cavity for use in a gyrotron device.

These and other objectives and advantages are provided by a novel drift tube for use between an electron gun and a cavity in a gyrotron traveling-wave device.

The drift tube includes a hollow waveguide positioned to surround an electron beam passing from the electron gun to the cavity. The electron beam travels through a medium enclosed by the waveguide. A plurality of parallel highly lossy dielectric suppressor rings surround the electron beam and are located adjacent to the inner surface of the waveguide. The suppressor rings act to absorb parasitic radiation produced by the electron beam. An anti-reflective means is included for matching the impedance of the suppressor rings to the medium in the waveguide thereby reducing reflections of incident radiation from the surfaces of the suppression rings.

These and other objectives and advantages are provided by a novel cavity for use in a gyrotron traveling-wave device. The cavity includes a hollow tuned cavity structure having an input port and an output port. The cavity structure is positioned to receive an electron beam through its input port. At least one highly lossy dielectric suppressor ring surrounds the electron beam and is located adjacent to the inner surface of the cavity structure in the vicinity of the output port. The suppresor ring (or rings) acts to absorb parasitic radiation produced by the electron beam. The cavity further includes an anti-reflecting means for matching the impedance of the suppressor ring (or rings) to a medium located within the cavity structure thereby reducing reflections of incident radiation from the surfaces of the suppressor ring (or rings).

These and other objectives and advantages are provided by a method for reducing parasitic oscillations within a gyrotron traveling-wave device which includes the steps of providing a hollow waveguide drift tube positioned between an electron gun and a cavity in a gyrotron. The drift tube surrounds an electron beam passing between the electron gun and the cavity. A plurality of parallel highly lossy dielectric suppressor rings are formed adjacent to the inner surface of the drift tube. The suppressor rings surround the electron beam to absorb parasitic radiation produced by the electron beam. An anti-reflective dielectric layer is formed on the surface of the plurality of suppressor rings. The anti-reflective layer acts to match the impedance of the suppressor rings to a medium enclosed within the drift tube and acts to reduce reflections of incident radiation from the surfaces of the suppressor rings.

These and other objectives and advantages are provided by a method for reducing parasitic oscillations within a gyrotron traveling-wave device including the steps of providing a hollow tuned cavity structure having an input port and an output port. The cavity structure is positioned within the gyrotron device to receive an electron beam through its input port. At least one highly lossy dielectric suppressor ring is formed adjacent to the inner surface of the cavity structure and positioned in the vicinity of the output port. The suppressor ring acts to absorb parasitic radiation produced by the electron beam. An anti-reflective layer is formed on the surface of the suppressor ring. The anti-reflective layer acts to match the impedance of the suppressor ring to a medium enclosed by the cavity structure and acts to reduce reflections of incident radiation from the surfaces of the suppressor ring.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
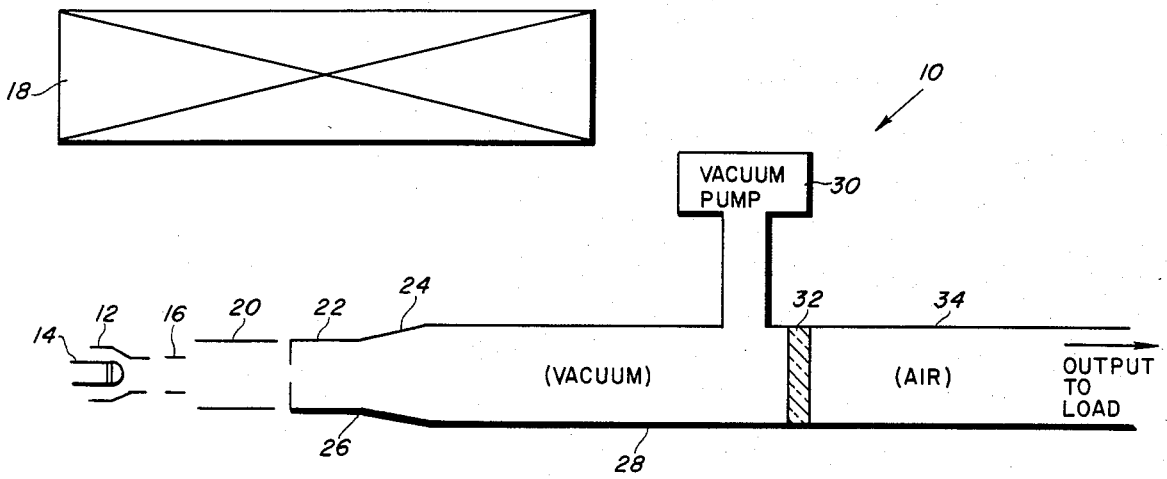
FIG. 1 is a cross-sectional view illustrating the overall structure of a gyrotron device.
Figure 1:
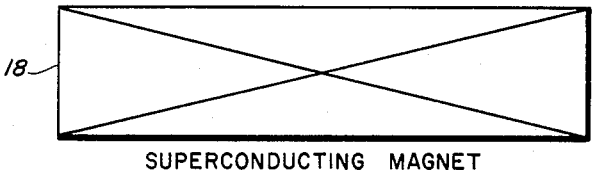

Referring now to the drawings, wherein like reference characters designate identical or corresponding parts throughout the several views, and more particularly to FIG. 1 thereof, a gyrotron device 10 is illustrated in cross-section.

The device 10 includes an electron gun 12 for generating a beam of electrons (not illustrated) supplied by a cathode 14. The electron beam is accelerated by an anode 16 which is maintained at a positive potential relative to the cathode 14. The electrons within the beam follow helical paths about the field lines of a large axial magnetic field supplied by a superconducting magnet 18, as is well-known in the art.

Downstream from the anode 16, the helical electron beam passes through a beam guide or drift tube 20 and enters a cavity 22. The dimensions of the cavity 22 are adjusted to support oscillation at a special frequency and at a specific mode of operation. The cavity 22 may include a tapered portion 24, as shown, which allows a smooth transition to an output waveguide.

The cavity 22 lies within the magnetic field supplied by the magnet 18 wherein the gyrotron interaction between the helical electron beam and the magnetic field occurs to produce intense electromagnetic waves at the tuned frequency of the cavity 22. The portion 28 of the cavity 22 exterior to the magnetic field acts as a collector to attract or collect the spent electrons within the beam.

The cavity 22 may take a variety of cross-sectional shapes such as oval, circular, rectangular, square, etc. For convenience, the cavity will be considered herein to be of circular cross-section. The cavity may be fabricated of standard waveguide materials. The region within the cavity 22 is evacuated to a vacuum of about $10^{-8}$ TORR by means of a vacuum pump 30 as is standard practice in microwave devices.

The entire device 10 is enclosed within a Dewar structure (not shown) of suitable design to maintain proper temperatures and pressures for super-conducting operation. The Dewar structure must surround the superconducting magnet 18 so as to cool the magnet by means of an appropriate liquid, such as liquid helium. The Dewar structure should be made of a material such as non-magnetic stainless steel which is suitable for the purpose herein described.

Electromagnetic waves developed within the cavity 22 pass through a vacuum window 32 located at the end of the cavity farthest from the electron gun 12. The waves passing through the window 32 are coupled to a suitable load, such as an antenna or dummy load (not illustrated), by means of a suitable output coupler waveguide 34, as is well-known in the art.

Generally in gyrotron devices, the magnetic field produced by the superconducting magnet 18 has a non-uniform magnetic field in the axial direction of the device 10. For example, the magnetic field strength in the vicinity of the electron gun 12 is typically in the range of $2\times10^3$ Gauss; whereas, the field strength typically ranges between $10\times10^3$ and $80\times10^3$ Gauss in the cavity 22. The strength of the magnetic field transitions sharply between these low and high levels in the region surrounding the drift tube 20 which is a portion of waveguide positioned between the anode 16 and the cavity 22.

As the helical electron beam traverses between the electron gun 12 and the cavity 22, the beam passes through the drift tube 20 wherein the electrons within the beam are subjected to the rapidly increasing magnetic field. Due to the increasing magnetic field, the energy of the beam increases and the radius of the helical path of the beam decreases (Adiabatic compression). During this change in the helical electron beam as a result of the increasing magnetic field, the individual electrons within the beam generally exhibit some bunching effects and thus begin to oscillate at many different modes or frequencies giving rise to spurious or parastic oscillations. If a bunched electron beam is injected into the cavity 22, the energy developed within the cavity will be coupled into many modes in addition to the desired mode and thus will not be directed completely to the desired mode thereby drastically reducing the efficiency of the device. Thus oscillations occurring within the drift tube are detrimental to efficient operation and therefore are highly undesirable.

Figure 2:
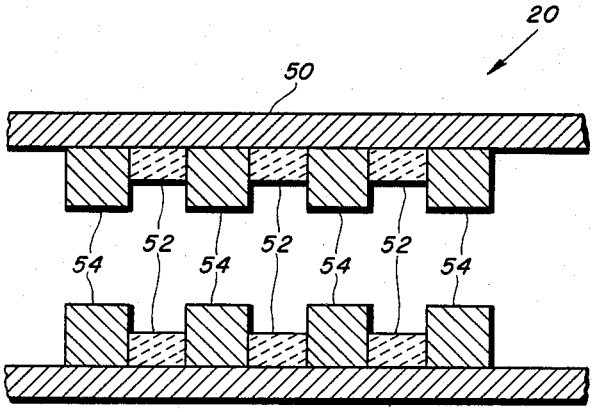
PRIOR ART FIG. 2
FIG. 2 illustrates a prior art drift tube used in the gyrotron device shown in FIG. 1.

FIG. 2 shows an enlarged partial longitudinal cross-section of the drift tube 20 and will be used to describe a prior art solution to the spurious oscillation problem. The drift tube 20 includes an outer shell or waveguide 50 made from a typical waveguide material. Generally drift tubes are cylindrical in shape although other cross-sectional shapes can be used. Within the waveguide 50 are located a plurality of suppressor rings 52 interspaced with and in contact with a plurality of highly conductive rings 54, made from material such as copper. The suppressor rings 52 are formed of a highly lossy dielectric ceramic material, such as Ceralloy TM, which is a mixture of 60% BeO with 40% SiC. The suppressor rings 52 act to absorb the parasitic modes thereby suppressing certain of the undesired modes. The conductive rings 54 are included to bleed off to the waveguide 50 static charges developed on the dielectric suppressor rings 52, which would otherwise deflect or alter the helical electron beam.

Although the prior art drift tube structure 20, including the suppressor rings 52, shown in FIG. 2 partially reduces parastic oscillations in the drift tube, it is not completely effective. In order for the supressor rings to absorb the unwanted radiation, they must be made of highly lossy and, as a result, high dielectric constant materials. However, due to the high dielectric constant of these materials, a large impedance mismatch exists between the high vacuum inside the drift tube and the suppressor rings and, as a result, approximately 50% of the incident radiation is reflected from the surface of the suppressor rings back into the drift tube. This reflection effect severly limits the effectiveness of the suppressor rings in absorbing parasitic radiation.

Figure 3:
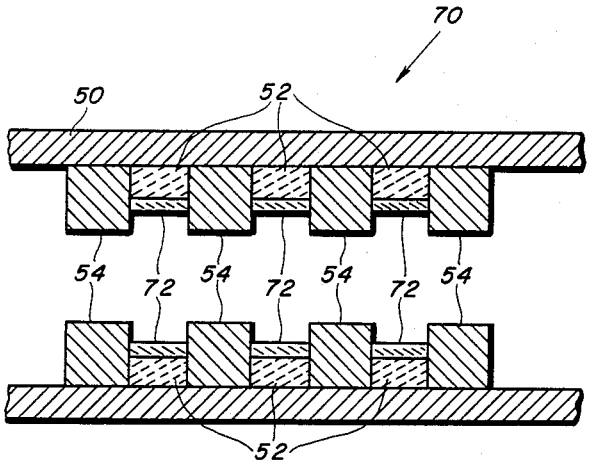
FIG. 3 illustrates an improved drift tube for use in the gyrotron device shown in FIG. 1 according to a preferred embodiment of the present invention.

FIG. 3 illustrates an improved drift tube 70 according to a preferred embodiment of the present invention. The improved drift tube 70 includes a plurality of highly lossy dielectric ceramic suppressor rings 52 interspaced with a plurality of conductive anti-static rings 54 as described above with respect to the prior art drift tube 20 shown in FIG. 2. Additionally, the improved drift tube 70 includes a plurality of anti-reflecting dielectric layers 72 located on the inner surfaces of the suppresson rings 52. The anti-reflecting dielectric layers 72 act to improve the impedance match between the medium within the drift tube (usually vacuum) and the surfaces of the suppressor rings 52 and thus act to prevent the incident radiation from being reflected from the surface of the suppressor rings thereby allowing a much greater amount of the incident radiation to be absorbed by the lossy material of the suppressor rings. In FIG. 3 only a small number of interspaced suppressor rings 52 and conductive rings 54 are illustrated. It should be understood that, in general, a large number of rings will be used.

To optimize the effectiveness of the anti-reflecting layers 72, the dielectric constant of the material used to form the layers should be equal to, or at least approximately equal to, the root mean value of the dielectric constants of media at the surface to the matched. Thus:

$$\epsilon_{LAYER} = \sqrt{(\epsilon_{MEDIUM})(\epsilon_{SUBSTRATE})} \quad (1)$$

where $\epsilon_{layer}$ is the dielectric constant of the anti-reflecting layer 72, $\epsilon_{medium}$ is the dielectic constant of the medium within the drift tube (approximately equal to 1 for vacuum), and $\epsilon_{substrate}$ is the dielectric constant of the material forming the suppressor rings 52.

The inventor has determined that the necessary thickness of the anti-reflecting layer 72 can be determined as follows:

$$d = m\lambda g/4n \quad (2)$$

where d is the layer thickness, λg is the waveguide wavelength of the drift tube 70, n is the index of refraction of the anti-reflecting layer and, m is a positive odd integer. From Maxwell's relation, $n=\sqrt{\epsilon}$, where $\epsilon$ is the dielectric constant. Therefore, equation (3) may be conveniently re-written as:

$$d = m\lambda g/4\sqrt{\epsilon_{LAYER}} \quad (3)$$

In addition to having an appropriate dielectric constant, as given by equation (1), and an appropriate thichness, as given by equation (2), the material used to form the anti-relecting layer 72 should be vacuum compatable (no significant outgassing characteristics) and should be sufficiently machinable to allow proper fabrication of the layer.

In a typical practical embodiment, the drift tube 70 shown in FIG. 3 was incorporated in a gyrotron device as shown in FIG. 1 for operation at 35 GHz. In this embodiment, 25 Ceralloy TM rings were interspaced with 26 copper rings in a 0.5 inch diameter cylindrical drift tube. Each Ceralloy TM ring was 0.1 inch wide and 0.05 inch thick. Each conductive ring was 0.1 inch wide and 0.1 inch thick. The Ceralloy TM and copper rings were machined to size and mounted in the waveguide 50 by means of press fitting. The dielectric constant of Ceralloy TM is equal to 50. Therefore, from equation (1) the desired dielectric constant for the anti-reflecting layer 72 was determined to be approximately 7.1. The present inventor has determined that a ceramic material called Macor TM (Corning Glass No. 9658), having a dielectric constant of 5.6, is sufficient to provide satisfactory results. The layer thickness for Macor TM was determined from equation (3) to be 0.85 mm. The Macor TM material was machined to size and press fit into the Ceralloy TM supressor rings. This embodiment has proven to be effective in reducing parasitic oscillations in the drift tube.

Figure 4:
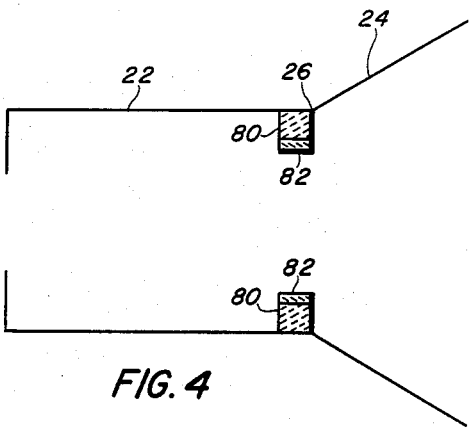
FIG. 4 illustrates an improved cavity for use in the gyrotron device shown in FIG. 1 according to a preferred embodiment of the present invention.

FIG. 4 illustrates another preferred embodiment of the present invention. In FIG. 4 a partial longitudinal cross-section of the cavity 22 is shown. Generally a $TE_{on}$ type mode has an insignificant electric field strength near the output end 26 of the cavity 22. Thus a means may be provided for suppressing radiation in the vicinity of the output end 26 with little risk of disturbing $TE_{on}$ type modes. The absorption may be accomplished by placing one or more suppressor rings 80 in this portion of the cavity as illustrated. Generally on suppressor ring having a width ranging between 5% and 10% of the cavity length has proven to provide satisfactory results. The ring, or rings, should be made of highly lossy dielectric material such as Ceralloy TM, as previously described.

To prevent reflections from the surface of the suppressor ring, an anti-reflecting dielectric layer 82 is formed on the surface to impedance match the suppressor ring to the vacuum or other media within the cavity. The dielectric constant of the layer 82 and the necessary thichness of the layer 82 may be determined from equations (1) and (2) given above. For this application λg in Equation (2) represent the waveguide wavelength of the cavity 22. Macor TM has been determined to be an acceptable material for forming anti-reflecting layers on Ceralloy TM suppressor rings as described above.

In a practical embodiment, the Ceralloy TM suppressor rings and the Macor TM anti-reflective layer were machined to size and press fit into the cavity 22. The inclusion of the anti-reflecting layered suppressor rings in the cavity 22 has resulted in an effective suppression of $TE_{MN}$ type modes over $TE_{ON}$ modes.

The improved cavity 22 incorporating one or more suppressor rings 80 with an anti-reflective layer 82, as shown in FIG. 4, may be used alone or in conjunction with the improved drift tube 70 shown in FIG. 3. When combined, the non-reflecting rings in the drift tube and in the cavity have proven to approach 100 percent microwave absorption thereby effectively suppressing parastic oscillations.

Obviously, numerous (additional) modifications and variations of the present invention are possible in light of the above teachings. It if therefore to be understood that within the scope of the appended claims, the present invention may be practiced otherwise than as specifically described herein.

What is claimed as new and desired to be secured by Letters Patent of the United States is:

1. A drift tube for use between an electron gun and a cavity in a gyrotron traveling-wave device comprising:

a hollow waveguide positioned to surround an electron beam passing from said electron gun to said cavity, said waveguide enclosing a medium through which said electron beam travels;

a plurality of parallel highly lossy dielectric suppressor rings surrounding said electron beam and located adjacent to the inner surface of said waveguide, said suppressor rings acting to absorb parasitic radiation produced by said electron beam; and an anti-reflective layer for matching the impedance of said suppressor rings to said medium and for reducing reflections of incident radiation from the surfaces of said suppressor rings located on the surfaces of said plurality of suppression rings, said anti-reflective layer being formed of a dielectric material having a dielectric constant determined according to the equation:

$$\epsilon_{layer} = \sqrt{(\epsilon_{medium})(\epsilon_{substrate})}$$

where $\epsilon_{layer}$ is the dielectric constant of said coating layer, $\epsilon_{medium}$ is the dielectric constant of said medium, and $\epsilon_{substrate}$ is the dielectric constant of said suppressor rings.

2. A drift tube for use between an electron gun and a cavity in a gyrotron traveling-wave device comprising:

a hollow waveguide positioned to surround an electron beam passing from said electron gun to said cavity, said waveguide enclosing a medium through which said electron beam travels;

a plurality of parallel highly lossy dielectric suppressor rings surrounding said electron beam and located adjacent to the inner surface of said waveguide, said suppressor rings acting to absorb parasitic radiation produced by said electron beam; and an anti-reflective layer for matching the impedance of said suppressor rings to said medium and for reducing reflections of incident radiation from the surfaces of said suppressor rings located on the surface of said plurality of suppression rings, said anti-reflective layer, being formed of a dielectric material having a dielectric constant determined according to the equation:

$$\epsilon_{layer} = \sqrt{(\epsilon_{medium})(\epsilon_{substrate})}$$

where $\epsilon_{layer}$ is the dielectric constant of said coating layer, $\epsilon_{medium}$ is the dielectric constant of said medium, and $\epsilon_{substrate}$ is the dielectric constant of said suppressor rings; and a plurality of parallel highly conductive rings surrounding said electron beam and located in contact with the inner surface of said waveguide, said plurality of conductive rings being interspaced with said plurality of suppressor rings, said conductive rings acting to remove static charges from said plurality of suppressor rings.

3. A drift tube for use between an electron gun and a cavity in a gyrotron traveling-wave device comprising:

a hollow waveguide positioned to surround an electron beam passing from said electron gun to said cavity, said waveguide enclosing a medium through which said electron beam travels;

a plurality of parallel highly lossy dielectric suppressor rings surrounding said electron beam and located adjacent to the inner surface of said waveguide, said suppressor rings acting to absorb parasitic radiation produced by said electron beam; and an anti-reflective layer for matching the impedance of said suppressor rings to said medium and for reducing reflections of incident radiation from the surfaces of said suppressor rings located on the surfaces of said plurality of suppression rings, said anti-reflective layer having a thickness determined according to the equation:

$$d = m\lambda g/4n$$

where d is the thickness of said anti-reflective layer, λ g is the waveguide wavelength of said waveguide, n is the index of refraction of anti-reflective layer, and m is a positive odd integer.

4. A drift tube a hollow waveguide positioned to surround an electron beam passing from said electron gun to said cavity, said waveguide enclosing a medium through which said electron beam travels;

a plurality of parallel highly lossy dielectric suppressor rings surrounding said electron beam and located adjacent to the inner surface of said waveguide, said suppressor rings acting to absorb parasitic radiation produced by said electron beam;

an anti-reflective layer for matching the impedance of said suppressor rings to said medium and for reducing reflections of incident radiation from the surfaces of said suppressor rings located on the surfaces of said plurality of suppression rings, said anti-reflective layer having a thickness determined according to the equation:

$$d = m\lambda g/4n$$

where d is the thickness of said anti-reflective layer, λ g is the waveguide wavelength of said waveguide, n is the index of refraction of anti-reflective layer, and m is a positive odd integer; and a plurality of parallel highly conductive rings surrounding said electron beam and located in contact with the inner surface of said waveguide, said plurality of conductive rings being interspaced with said plurality of suppressor rings, said conductive rings acting to remove static charges from said plurality of suppressor rings.

5. A drift tube for use between an electron gun and a cavity in a gyrotron traveling-wave device, comprising:

a hollow waveguide positioned to surround an electron beam passing from said electron gun to said cavity, said waveguide enclosing a medium through which said electron beam travels;

a plurality of parallel highly lossy dielectric suppressor rings surrounding said electron beam and located adjacent to the inner surface fo said waveguide, said suppressor rings acting to absorb parasitic radiation produced by said electron beam;

a plurality of highly conductive rings surrounding said electron beam and located in contact with the inner surface of said waveguide, said plurality of conductive rings being interspaced with said plurality of suppressor rings, said conductive rings acting to remove static charges from said plurality of suppressor rings;

an anti-reflective dielectric layer located on the surfaces of said plurality of suppressor rings, said anti-reflective layer matching the impedance of said suppressor rings to said medium, said anti-reflective layer reducing reflections of incident radiation from the surface of said suppressor rings;

said anti-reflective layer having a dielectric constant determined according to the equation:

$$\epsilon_{layer} = \sqrt{(\epsilon_{medium})(\epsilon_{substrate})}$$

where $\epsilon_{layer}$ is the dielectric constant of said anti-reflective layer, $\epsilon_{medium}$ is the dielectric constant of said medium, and $\epsilon_{substrate}$ is the dielectric constant of said suppressor rings.

6. A drift tube for use between an electron gun and a cavity in a gyrotron traveling-wave device, comprising;

a hollow waveguide positioned to surround an electron beam passing from said electron gun to said cavity, said waveguide enclosing a medium through which said electron beam travels;

a plurality of parallel highly lossy dielectric suppressor rings surrounding said electron beam and located adjacent to the inner surface of said waveguide, said suppressor rings acting to absorb parasitic radiation produced by said electron beam;

a plurality of highly conductive rings surrounding said electron beam and located in contact with the inner surface of said waveguide, said plurality of conductive rings being interspaced with said plurality of suppressor rings, said conductive rings acting to remove static charges from said plurality of suppressor rings;

an anti-reflective dielectric layer located on the surfaces of said plurality of suppressor rings, said anti-reflective layer matching the impedance of said suppressor rings to said medium, said anti-reflective layer reducing reflections of incident radiation from the surface of said suppressor rings, said anti-reflective layer having a thickness determined according to the equation:

$$d = m\lambda g/4n$$

where d is the thickness of said anti-reflective layer, λ g is the waveguide wavelength of said waveguide, n is the index of refraction of said anti-reflective layer, and m is a positive odd integer.

7. A drift tube for use between an electron gun and a cavity in a gyrotron traveling-wave device, comprising:

a hollow wavegude positioned to surround an electron beam passing from said electron gun to said cavity, said waveguide enclosing a medium through which said electron beam travels;

a plurality of parallel highly lossy dielectric suppressor rings surrounding said electron beam and located adjacent to the inner surface of said waveguide, said suppressor rings acting to absorb parasitic radiation produced by said electron beam;

a plurality of highly conductive rings surrounding said electron beam and located in contact with the inner surface of said waveguide, said plurality of conductive rings being interspaced with said plurality of suppressor rings, said conductive rings acting to remove static charges from said plurality of suppressor rings;

an anti-reflective dielectric layer located on the surfaces of said plurality of suppressor rings, said anti-reflective layer matching the impedance of said suppressor rings to said medium, said anti-reflective layer reducing reflections of incident radiation from the surface of said suppressor rings; and wherein:

said suppressor rings are formed of Ceralloy TM;

said conductive rings are formed of copper; and said anti-reflective layer is formed of Macor TM.

8. A cavity for use in a gyrotron traveling-wave device, comprising:

a hollow tuned cavity structure including an input port and an output port, said cavity structure being positioned to receive an electron beam through its input port;

at least one highly lossy dielectric suppressor ring surrounding said electron beam and located adjacent to the inner surface of said cavity structure in the vicinity of said output port, said at least one suppressor ring acting to absorb parasitic radiation produced by said electron beam;

an anti-reflective layer for matching the impedance of said at least one suppressor ring to a medium located within said cavity structure and for reducing reflections of incident radiation from the surfaces of said at least one suppressor ring, said anti-reflective layer located on the surface of said at least one suppressor ring, said anti-reflective layer being formed of a dielectric material, and said anti-reflective layer has a dielectric constant determined according to the equation:

$$\epsilon_{layer} = \sqrt{(\epsilon_{medium})(\epsilon_{substrate})}$$

where $\epsilon_{layer}$ is the dielectric constant of said anti-reflective layer, $\epsilon_{medium}$ is the dielectric constant of said medium, and $\epsilon_{substrate}$ is the dielectric constant of said at least one suppressor ring.

9. A cavity for use in a gyrotron traveling-wave device, comprising:

a hollow tuned cavity structure including an input port and an output port, said cavity structure being positioned to receive an electron beam through its input port;

at least one highly lossy dielectric suppressor ring surrounding said electron beam and located adjacent to the inner surface of said cavity structure in the vicinity of said output port, said at least one suppressor ring acting to absorb parasitic radiation produced by said electron beam;

an anti-reflective layer for matching the impedance of said at least one suppressor ring to a medium located within said cavity structure and for reducing reflections of incident radiation from the surfaces of said at least one suppressor ring, said anti-reflective layer located on the surface of said at least one suppressor ring, said anti-reflective layer being formed of a dielectric material, and said anti-reflective layer has a thickness determined according to the equation:

$$d = m\lambda g/4n$$

where d is the thickness of said anti-reflective layer, λ g is the waveguide wavelength of said cavity structure, n is the index of refraction of said anti-reflective layer, and m is a positive odd integer.

10. A method for reducing parasitic oscillations within a gyrotron traveling-wave device comprising the steps of:

providing a hollow waveguide drift tube positioned between an electron gun and a cavity in said gyrotron, said drift tube surrounding an electron beam passing between said electron gun and said cavity;

forming a plurality of parallel highly lossy dielectric suppressor rings adjacent to the inner surface of said drift tube, said suppressor rings surrounding said electron beam to absorb parasitic radiation produced by said electron beam; and forming an anti-reflective dielectric layer on the surfaces of said plurality of suppressor rings, said anti-reflective layer matching the impedance of said suppressor rings to a medium enclosed within said drift tube and reducing reflections of incident radiation from the surfaces of said suppressor rings, said anti-reflective layer is formed of a material having a dielectric constant determined according to the equation:

$$\epsilon_{layer} = \sqrt{(\epsilon_{medium})(\epsilon_{substrate})}$$

where $\epsilon_{layer}$ is the dielectric constant of the anti-reflective layer, $\epsilon_{medium}$ is the dielectric constant of said medium, and $\epsilon_{substrate}$ is the dielectric constant of said suppressor rings.

11. A method for reducing parasitic oscillations within a gyrotron traveling-wave device comprising the steps of:

providing a hollow waveguide drift tube positioned between an electron gun and a cavity in said gyrotron, said drift tube surrounding an electron beam passing between said electron gun and said cavity;

forming a plurality of parallel highly lossy dielectric suppressor rings adjacent to the inner surface of said drift tube, said suppressor rings surrounding said electron beam to absorb parasitic radiation produced by said electron beam; and forming an anti-reflective dielectric layer on the surfaces of said plurality of suppressor rings, said anti-reflective layer matching the impedance of said suppressor rings to a medium enclosed within said drift tube and reducing reflections of incident radiation from the surfaces of said suppressor rings, said anti-reflective layer is formed to a thickness determined according to the equation:

$$d = m\lambda g/4n$$

where d is the thickness of the anti-reflective layer, λ g is the waveguide wavelength of said drift tube, n is the index of refraction of said anti-reflective layer, and m is a positive odd integer.

12. A method for reducing parasitic oscillations within a gyrotron traveling wave device comprising the steps of:

providing a hollow tuned cavity structure including an input port and an output port, said cavity structure being positioned within said gyrotron to receive an electron beam through its input port;

forming at least one highly lossy dielectric suppressor ring adjacent to the inner surface of said cavity structure and positioned in the vicinity of said output port, said at least one suppressor ring acting to absorb parasitic radiation produced by said electron beam; and forming an anti-reflective dielectric layer on the surfaces of said at least one suppressor ring, said anti-reflective layer matching the impedance of said at least one suppressor ring to a medium enclosed by said cavity structure and reducing reflections of incident radiation from the surface of said at least one suppressor ring, said anti-reflective layer is formed of a material having a dielectric constant determined according to the equation:

$$\epsilon_{layer} = \sqrt{(\epsilon_{medium})(\epsilon_{substrate})}$$

where $\epsilon_{layer}$ is the dielectric constant of the anti-reflective layer, $\epsilon_{medium}$ is the dielectric constant of said medium, and $\epsilon_{substrate}$ is the dielectric constant of said at least one suppressor ring.

13. A method for reducing parasitic oscillations within a gyrotron traveling-wave device comprising the steps of:

providing a hollow tuned cavity structure including an input port and an output port, said cavity structure being positioned in the vicinity of said output port, said at least one suppressor ring acting to absorb parasitic radiation produced by said electron beam; and forming an anti-reflective dielectric layer on the surfaces of said at least one suppressor ring, said anti-reflective layer matching the impedance of said at least one suppressor ring to a medium enclosed by said cavity structure and reducing reflections of incident radiation from the surfaces of said at least one suppressor ring, said anti-reflective layer is formed to a thickness determined according to the equation:

$$d = m\lambda g/4n$$

where d is the thickness of the anti-reflective layer, λ g is the waveguide wavelength of said cavity structure, n is the index of refraction of said anti-reflective layer, and m is a positive odd integer.

* * * * *